US010234207B2

(12) United States Patent
Salters et al.

(10) Patent No.: US 10,234,207 B2
(45) Date of Patent: Mar. 19, 2019

(54) COOLING APPARATUS FOR COOLING A FLUID BY MEANS OF SURFACE WATER

(71) Applicant: KONINKLIJKE PHILIPS N.V., Eindhoven (NL)

(72) Inventors: Bart Andre Salters, Eindhoven (NL); Roelant Boudewijn Hietbrink, Utrecht (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/534,573

(22) PCT Filed: Dec. 9, 2015

(86) PCT No.: PCT/EP2015/079176
§ 371 (c)(1),
(2) Date: Jun. 9, 2017

(87) PCT Pub. No.: WO2016/091982
PCT Pub. Date: Jun. 16, 2016

(65) Prior Publication Data

US 2017/0343287 A1 Nov. 30, 2017

(30) Foreign Application Priority Data

Dec. 12, 2014 (EP) ..... 14197753

(51) Int. Cl.
*F28F 3/00* (2006.01)
*F28D 1/02* (2006.01)
(Continued)

(52) U.S. Cl.
CPC ..... *F28D 1/022* (2013.01); *B63H 21/383* (2013.01); *B63J 2/12* (2013.01); *F01P 11/06* (2013.01);
(Continued)

(58) Field of Classification Search
CPC ..... F28F 19/00; F28F 1/325; F28F 2265/20; B63J 2/12; B63J 19/123; F28D 1/022;
(Continued)

(56) References Cited

U.S. PATENT DOCUMENTS 4,778,653 A 10/1988 Kamimura et al.
2006/0266042 A1* 11/2006 Levine ..... F01K 9/003 60/645
(Continued)

FOREIGN PATENT DOCUMENTS

DE 102008006464 A1 1/2009
DE 102010052446 A1 2/2012
(Continued)

OTHER PUBLICATIONS

Philipp, Gerit et al., "Elimination and Avoidance of Micro-Organisms in Heat Exchangers and Water Circulation Equipments", Sep. 25, 2014, pp. 220-221.

*Primary Examiner* — Davis D Hwu

(57) ABSTRACT

A cooling apparatus for cooling a fluid by surface water includes more than one tubes for containing and transporting the fluid in its interior, the exterior of the tube being in operation at least partially submerged in the surface water so as to cool the tube to thereby also cool the fluid. The cooling apparatus also includes at least one light source for producing light that hinders fouling on at least part of the submerged exterior, and at least one optic unit for enhancing the distribution of anti-fouling light on the submerged exterior.

20 Claims, 2 Drawing Sheets

(51) Int. Cl.

| | |
|---|---|
| ***F28F 19/00*** | (2006.01) |
| ***F28F 19/04*** | (2006.01) |
| ***F28D 1/047*** | (2006.01) |
| ***B63H 21/38*** | (2006.01) |
| ***B63J 2/12*** | (2006.01) |
| ***F01P 11/06*** | (2006.01) |
| *F28D 21/00* | (2006.01) |

(52) U.S. Cl.
CPC ..... *F28D 1/0475* (2013.01); *F28F 19/00* (2013.01); *F28F 19/04* (2013.01); *F01P 2050/06* (2013.01); *F28D 2021/0092* (2013.01); *F28D 2021/0094* (2013.01)

(58) Field of Classification Search
CPC ..... F28D 1/0475; F28D 2021/0092; B63B 59/04
USPC ..... 165/41
See application file for complete search history.

(56) References Cited

U.S. PATENT DOCUMENTS

| | | | | |
|---|---|---|---|---|
| 2013/0048877 | A1* | 2/2013 | Thoren | G02B 6/102 250/492.1 |
| 2014/0196745 | A1 | 7/2014 | Whelan et al. | |
| 2017/0190397 | A1* | 7/2017 | Salters | B01J 19/123 |
| 2017/0197693 | A1* | 7/2017 | Salters | B63B 59/04 |
| 2017/0343305 | A1* | 11/2017 | Salters | F28F 19/00 |

FOREIGN PATENT DOCUMENTS

| | | | |
|---|---|---|---|
| EP | 1233159 | A1 | 8/2002 |
| EP | 2127518 | A1 | 12/2009 |
| EP | 2485003 | A1 | 8/2012 |
| JP | 63162091 | A | 7/1988 |
| JP | 5023502 | B2 | 4/1993 |
| WO | 2001025086 | A1 | 4/2001 |
| WO | 2011078711 | A1 | 6/2011 |

* cited by examiner

COOLING APPARATUS FOR COOLING A FLUID BY MEANS OF SURFACE WATER

CROSS-REFERENCE TO PRIOR APPLICATIONS

This application is the U.S. National Phase application under 35 U.S.C. § 371 of International Application No. PCT/EP2015/079176, filed on 9 Dec. 2015, which claims the benefit of European Patent Application No. 14197753.8, filed on 12 Dec. 2014. These applications are hereby incorporated by reference herein.

FIELD OF THE INVENTION

The present disclosure relates to a cooling apparatus which is adapted for the prevention of fouling, commonly referred to as anti-fouling. The disclosure specifically relates to anti-fouling of the sea box coolers.

BACKGROUND OF THE INVENTION

Bio fouling or biological fouling is the accumulation of microorganisms, plants, algae, and/or animals on surfaces. The variety among bio fouling organisms is highly diverse and extends far beyond attachment of barnacles and seaweeds. According to some estimates, over 1800 species comprising over 4000 organisms are responsible for bio fouling. Bio fouling is divided into micro fouling which includes bio film formation and bacterial adhesion, and macro fouling which is the attachment of larger organisms. Due to the distinct chemistry and biology that determine what prevents them from settling, organisms are also classified as hard or soft fouling types. Calcareous (hard) fouling organisms include barnacles, encrusting bryozoans, mollusks, polychaete and other tube worms, and zebra mussels. Examples of non-calcareous (soft) fouling organisms are seaweed, hydroids, algae and bio film "slime". Together, these organisms form a fouling community.

In several circumstances bio fouling creates substantial problems. Machinery stop working, water inlets get clogged, and heat exchangers suffer from reduced performance. Hence the topic of anti-fouling, i.e. the process of removing or preventing bio fouling from forming, is well known. In industrial processes, bio-dispersants can be used to control bio fouling. In less controlled environments, organisms are killed or repelled with coatings using biocides, thermal treatments or pulses of energy. Nontoxic mechanical strategies that prevent organisms from attaching include choosing a material or coating with a slippery surface, or creation of nanoscale surface topologies similar to the skin of sharks and dolphins which only offer poor anchor points.

Antifouling arrangements for cooling units that cool the engine fluid of a ship via seawater are known in the art. DE102008029464 relates to a sea box cooler comprising an antifouling system by means of regularly repeatable overheating. Hot water is separately supplied to the heat exchanger tubes so as to minimize the fouling propagation on the tubes.

SUMMARY OF THE INVENTION

Bio fouling on the inside of box coolers causes severe problems. The main issue is a reduced capacity for heat transfer as the thick layers of bio-fouling are effective heat insulators. As a result, the ship engines have to run at a much lower speed, slowing down the ship itself, or even come to a complete halt, due to over-heating.

There are numerous organisms that contribute to bio fouling. This includes very small organisms like bacteria and algae, but also very large ones such as crustaceans. The environment, temperature of the water, and purpose of the system all play a role here. The environment of a box cooler is ideally suited for bio-fouling: the fluid to be cooled heats up to a medium temperature and the constant flow of water brings in nutrients and new organisms.

Accordingly methods and apparatus are necessary for anti-fouling. Prior art systems, however, may be inefficient in their use, require regular maintenance and in most cases result in ion discharge to the sea water with possible hazardous effects.

Hence, it is an aspect of the invention to provide a cooling apparatus for the cooling of a ships engine with an alternative anti-fouling system according to the appended independent claims. The dependent claims define advantageous embodiments.

Herewith an approach is presented based on optical methods, in particular using ultra-violet light (UV). It appears that most micro-organisms are killed, rendered inactive or unable to reproduce with 'sufficient' UV light. This effect is mainly governed by the total dose of UV light. A typical dose to kill 90% of a certain micro-organism is 10 mW-hours per square meter.

The cooling apparatus for the cooling of a ships engine is suitable to be placed in a closed box that is defined by the hull of the ship and partition plates. Entry and exit openings are provided on the hull so that sea water can freely enter the box volume, flow over the cooling apparatus and exit via natural flow. The cooling apparatus comprises a bundle of tubes through which a fluid to be cooled can be conducted and at least one light source for generating an anti-fouling light. The cooling apparatus of the present invention further at least one optic unit for enhancing the distribution of anti-fouling light on the submerged exterior.

The light source may be a lamp having a tubular structure in an embodiment of the cooling apparatus. For these light sources as the rather big all the light from a single source is concentrated in the neighboring area. Accordingly it is possible to achieve the desired level of anti-fouling with a limited number of light sources which render the solution rather cost effective.

The most efficient source for generating UVC is the low-pressure mercury discharge lamp, where on average 35% of input watts is converted to UVC watts. The radiation is generated almost exclusively at 254 nm viz. at 85% of the maximum germicidal effect. Philips' low pressure tubular fluorescent ultraviolet (TUV) lamps have an envelope of special glass that filters out ozone-forming radiation, in this case the 185 nm mercury line.

For various Philips germicidal TUV lamps the electrical and mechanical properties are identical to their lighting equivalents for visible light. This allows them to be operated in the same way i.e. using an electronic or magnetic ballast/starter circuit. As with all low pressure lamps, there is a relationship between lamp operating temperature and output. In low pressure lamps the resonance line at 254 nm is strongest at a certain mercury vapour pressure in the discharge tube. This pressure is determined by the operating temperature and optimizes at a tube wall temperature of 40° C., corresponding with an ambient temperature of about 25° C. It should also be recognized that lamp output is affected by air currents (forced or natural) across the lamp, the so called chill factor. The reader should note that, for some lamps, increasing the air flow and/or decreasing the temperature can increase the germicidal output. This is met in high output (HO) lamps viz. lamps with higher wattage than normal for their linear dimension.

A second type of UV source is the medium pressure mercury lamp, here the higher pressure excites more energy levels producing more spectral lines and a continuum (recombined radiation). It should be noted that the quartz envelope transmits below 240 nm so ozone can be formed from air. Advantages of medium pressure sources are:

high power density;

high power, resulting in fewer lamps than low pressure types being used in the same application; and less sensitivity to environment temperature.

The lamps should be operated so that the wall temperature lies between 600 and 900° C. and the pinch does not exceed 350° C. These lamps can be dimmed, as can low pressure lamps.

Further, Dielectric Barrier Discharge (DBD) lamps can be used. These lamps can provide very powerful UV light at various wavelengths and at high electrical-to-optical power efficiencies.

The germicidal doses needed can also easily be achieved with existing low cost, lower power UV LEDs. LEDs can generally be included in relatively smaller packages and consume less power than other types of light sources. LEDs can be manufactured to emit (UV) light of various desired wavelengths and their operating parameters, most notably the output power, can be controlled to a high degree.

In an embodiment of the cooling apparatus according the invention said optic unit at least partially extends towards in between the tubes. Accordingly the uniform and effective distribution of the anti-fouling light over the entire surface of the tubes' exterior is assured.

In an embodiment of the cooling apparatus according the invention the optic unit comprises at least one optical medium through which the light generated by the light source travels. The optical medium transfers the light generated by the light source towards areas of the tubes' exterior where anti-fouling light cannot reach and hence fouling in these regions is avoided as well.

In an embodiment of the present invention the optical medium comprises spaces, e.g. channels, filled with gas and/or clear water for guiding at least part of the anti-fouling light therethrough. In particular optical medium can be at least partly hollow and be filled gas and/or clear water.

In an embodiment of the cooling apparatus according the invention the optical medium is a light spreader arranged in front of the light source for spreading at least part of the anti-fouling light emitted by the light source in a direction having a component substantially parallel to the exterior of the tube. The optical medium is arranged in front of the at least one light source for spreading at least part of the anti-fouling light emitted by the at least one light source in a direction having a component substantially parallel to the exterior of the tube. An example of a light spreader may be a 'opposite' cone arranged in the optical medium and position opposite the at least one light source, where the opposite cone has a surface area with a 45° angle perpendicular to the exterior of the tube for reflecting light emitted by the light source perpendicular to said surface in an a direction substantially parallel to said surface.

In an embodiment of the cooling apparatus according the invention the optical medium is a light guide. In a preferred version of the said embodiment the optical medium is arranged in front of the at least one light source, the light guide having a light coupling-in surface for coupling in the anti-fouling light from the at least one light source and a light coupling-out surface for coupling-out the anti-fouling light in a direction towards the exterior of the tube. In other words specific sections of the optical medium are deliberately arranged so as to leak out light towards the exterior of the tube.

The optical medium in the above described embodiment distributes the light across a substantial part of the tubes' exterior and comprises silicone material and/or UV grade silica material, in particular quartz. UV grade silica has very low absorption for UV light and thus is very well suitable as optical medium material. Relatively large objects may be made from using plural relatively small pieces or portions of UV grade silica together and/or so-called "fused silica", while retaining the UV-transmissive properties also for the larger object. Silica portions embedded in silicone material protect the silica material. In such combination the silica portions may provide UV transparent scatterers in an otherwise silicone material optical medium for (re-)distribution of the light trough the optical medium and/or for facilitating out coupling of the light from a light guide. Also, silica particles and/or particles of other hard, UV translucent material may fortify the silicone material. In particular flake-shaped silica particles may be used, also in high density, of up to 50%, 70% or even higher percentages of silica in silicone material may provide a strong layer that can resist impacts. It is considered that at least a part of the optical medium or light guide may be provided with a spatially varying density of UV grade silica particles, in particular flakes, at least partly embedded in a silicone material, e.g. to vary optical and/or structural properties. Here, "flakes" denote objects having sizes in three Cartesian directions, wherein two of the three sizes may mutually differ, however, each being significantly larger, e.g. a factor 10, 20, or significantly more, e.g. factors of 100's, than the third size.

In an embodiment of the present invention the light guide comprises a light guide material having a refractive index higher than the refractive index of the liquid environment such that at least part of the anti-fouling light is propagated through the light guide via total internal reflection in a direction substantially parallel to the exterior of the tube before being out-coupled at the out-coupling surface. Some embodiment may comprise an optical medium which combines a light spreader and a light guide, or integrated light spreading features with light guiding features into the optical medium.

The at least one light source and/or the optical medium may be at least partly arranged in, on and/or near the exterior of the tube so as to emit the anti-fouling light in a direction away from the exterior of the tube. The light source is adapted to preferably emit the anti-fouling light while the exterior of the tube is at least partially submersed in an liquid environment.

In alternative embodiments of the present invention the optical medium is made either of glass, glass fiber, silicones or transparent plastics such as PMMA.

In an embodiment of the present invention the optical medium is in the form of a rod or fiber extending from the light source towards the tubes so that at least part of the optical medium lies in between two adjacent tubes.

In an embodiment of the present invention the optic unit is in the form of a restrictor which restricts the propagation of light waves away from and reflects the light towards the tubes' exterior which the light source hinders fouling on.

In an embodiment of the cooling apparatus the tubes are at least partially coated with an antifouling light reflective coating. Accordingly the antifouling light would reflect in a diffuse way and hence light is distributed more effectively over the tubes.

The invention also provides a ship comprising a cooling unit for cooling of the ship's engine as described above. In such an embodiment the inner surfaces of the box in which the cooling unit is placed may at least partially coated with an antifouling light reflective coating. Similarly to the embodiment above as a result of this particular embodiment the anti-fouling light would reflect in a diffuse way and hence light is distributed more effectively over the tubes.

It is an advantage of the presently provided solutions that the micro-organisms are not killed after having adhered and rooted on the fouling surface, as is the case for known poison dispersing coatings, but that the rooting of micro-organisms on the fouling surface is prevented. It is more efficient to actively kill micro-organism right before or just after they contact the fouling surface, compared to a light treatment to remove existing fouling with large micro-organism structures. The effect may be similar to the effect created by using nano-surfaces that are that smooth that micro-organism cannot adhere to it.

Because the low amount of light energy required for killing the micro-organism in the initial rooting stage, the system may be operated to continuously provide an anti-fouling light across a large surface without extreme power requirements.

The term "substantially" herein, will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "comprising" may in an embodiment refer to "consisting of" but may in another embodiment also refer to "containing at least the defined species and optionally one or more other species".

It is to be understood that the terms so used are interchangeable under appropriate circumstances and that the embodiments of the invention described herein are capable of operation in other sequences than described or illustrated herein.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The article "a" or "an" preceding an element does not exclude the presence of a plurality of such elements. The mere fact that certain measures are recited in mutually different dependent claims does not indicate that a combination of these measures cannot be used to advantage.

The invention further applies to a device comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF EMBODIMENTS

Figure 1:
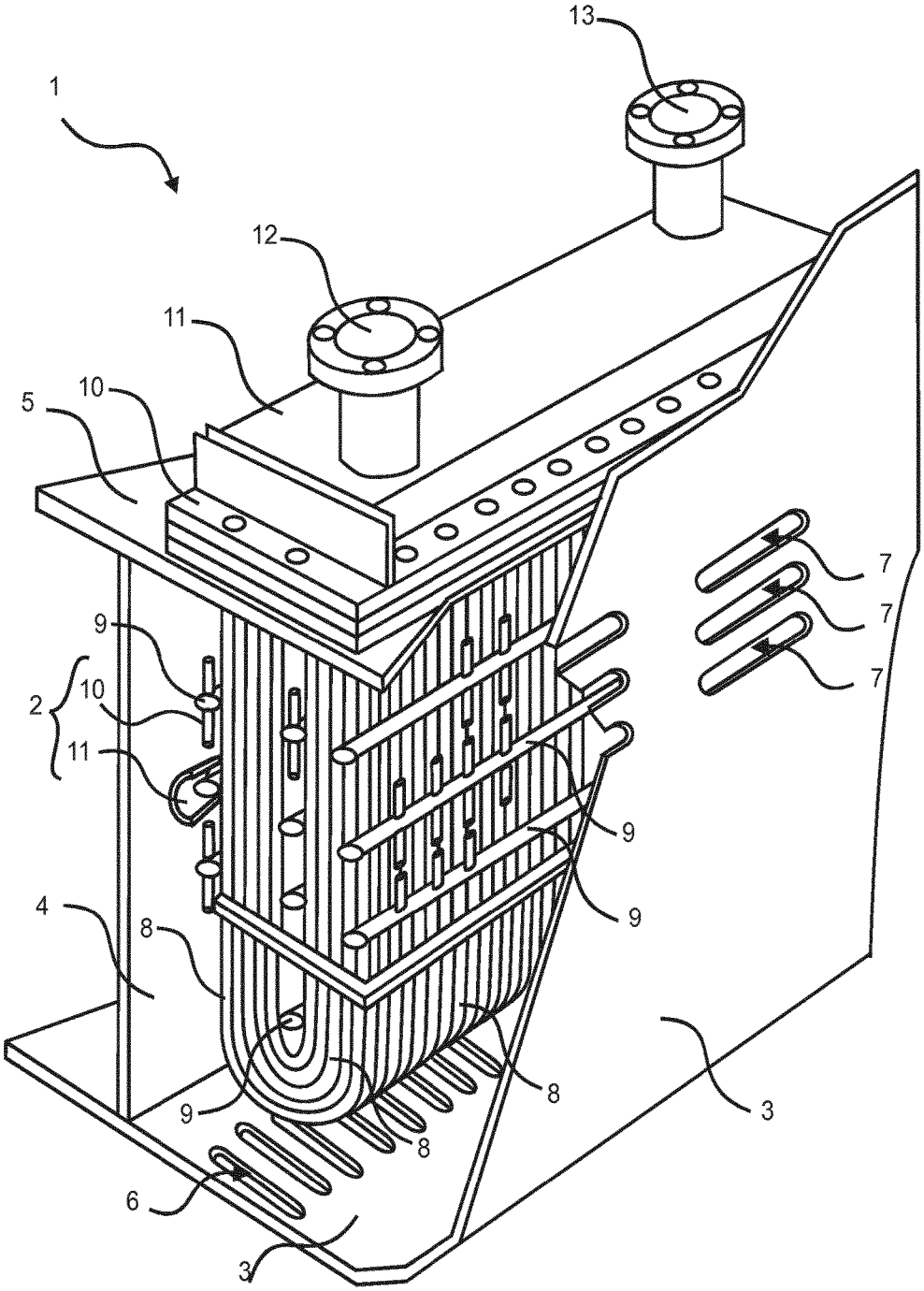
FIG. 1 is a schematic representation of an embodiment of the cooling apparatus.

While the disclosure has been illustrated and described in detail in the drawings and foregoing description, such illustration and description are to be considered illustrative or exemplary and not restrictive; the disclosure is not limited to the disclosed embodiments. It is further noted that the drawings are schematic, not necessarily to scale and that details that are not required for understanding the present invention may have been omitted. The terms "inner", "outer", "along" and the like relate to the embodiments as oriented in the drawings, unless otherwise specified. Further, elements that are at least substantially identical or that perform an at least substantially identical function are denoted by the same numeral.

FIG. 1 shows as a basic embodiment, a schematic view of a cooling apparatus (1) for the cooling of a ship's engine, placed in a closed box, defined by the hull (3) of the ship and partition plates (4,5) such that entry and exit openings (6,7) are provided on the hull so that sea water can freely enter the box volume, flow over the cooling apparatus and exit via natural flow, comprising a bundle of tubes (8) through which a fluid to be cooled can be conducted, at least one light source (9) for generating an anti-fouling light, arranged by the tubes (8) so as to emit the anti-fouling light on the tubes (8). Hot fluid enters the tubes (8) from above and conducted all the way and exits once again, now cooled from the top side. Meanwhile sea water enters the box from the entry openings (6), flows over the tubes (8) and receives heat from the tubes (8) and thus the fluid conducted within. Taking the heat from the tubes (8) sea water warms up and rises. The sea water then exits the box from the exit openings (7) which are located at a higher point on the hull (3). During this cooling process any bio organisms existing in the sea water tend to attach to the tubes (8) which are warm and provide a suitable environment for the organisms to live in, the phenomena known as fouling. To avoid such attachment at least one light source (9) is arranged by the tubes (8) and at least one optic unit (2) is arranged by the light source (9) for guiding anti-fouling light towards the submerged exterior of tubes (8). As illustrated in FIG. 1 one or more tubular lamps can be used as a light source (9) to realize the aim of the invention.

Figure 2:
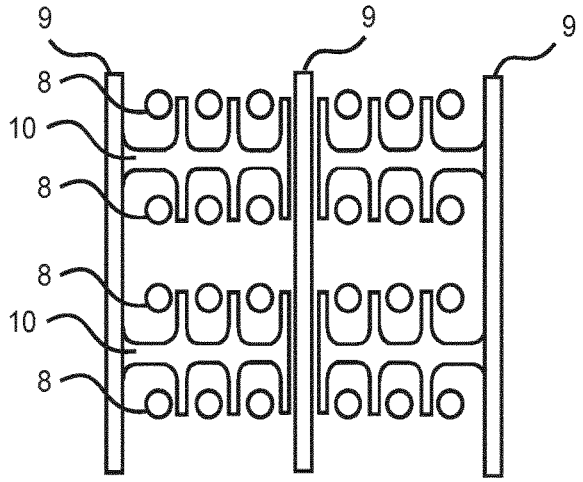
FIG. 2 is a schematic horizontal cross section view of an embodiment of the cooling apparatus.

FIG. 2 shows a cooling apparatus (1) wherein the optical unit (2) comprises multiple optical mediums (10) through which the light generated by the light source (9) travels and wherein the said optic units (2) at least partially lies in between two adjacent tubes (8). In this embodiment the optical medium (10) is a light guide. In this embodiment the optical medium (10) is in the form of a rod with branches, extending from the light source (9) towards the tubes (8).

Figure 3:
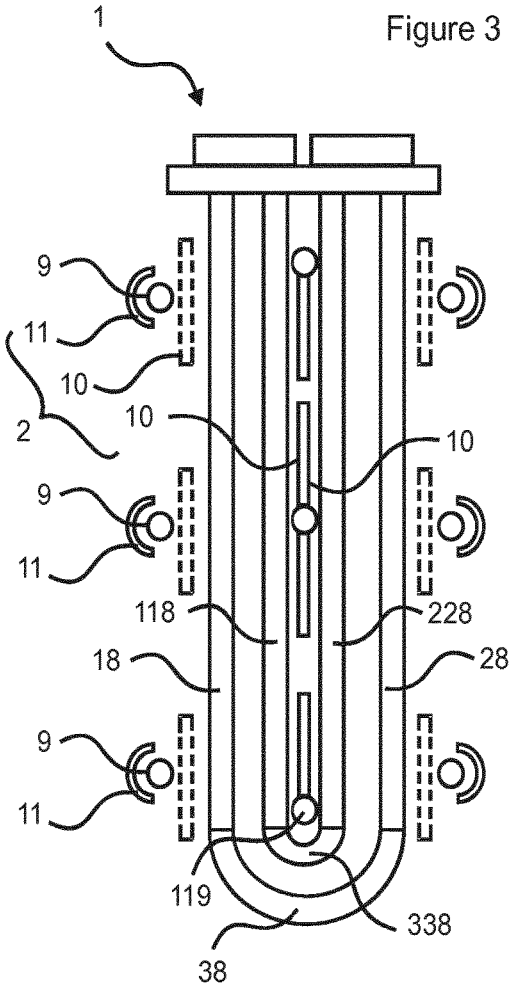
FIG. 3 is a schematic vertical cross section view of another embodiment of the cooling apparatus; and The drawings are not necessarily on scale.

FIG. 3 shows an embodiment wherein the light sources (9) arranged on the inner side of the tube (8) bundle are provided with optical mediums (10) that are in the form of light guides whereas the light sources (9) arranged on the outer side of the tube (8) bundle are provided with a light spreader in between the light source (9) and the tube (8) for spreading at least part of the anti-fouling light emitted by the light source (9) in one or more directions having a component substantially perpendicular to the exterior of the tube (8). In this embodiment the cooling apparatus (1) is further provided with reflectors (11) which restricts the propagation of light waves away from and reflects the light towards the tubes' (8) exterior which the light source (9) hinders fouling on.

Elements and aspects discussed for or in relation with a particular embodiment may be suitably combined with elements and aspects of other embodiments, unless explicitly stated otherwise. The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof. As fouling may also happen in rivers or lakes, the invention is generally applicable to cooling by means of any kind of surface water.

The invention claimed is:

1. A cooling apparatus for cooling a fluid by surface water, the cooling apparatus comprising:

tubes configured to contain and transport the fluid in the tubes, an exterior portion of at least one tube of the tubes being in operation at least partially submerged in the surface water so as to cool the tubes to thereby also cool the fluid;

at least one light source configured to generate anti-fouling light that hinders fouling on at least part of the exterior portion submerged in the surface water; and at least one optic guide configured to guide the anti-fouling light towards the at least part of the exterior portion submerged in the surface water, wherein the optical medium includes a rod having a main portion and branch portions, the main portion extending between two sources of the at least one light source, and the branch portions extending from main portion towards the tubes.

2. The cooling apparatus according to claim 1, wherein the at least one optic guide at least partially lies in between two adjacent tubes of the tubes.

3. The cooling apparatus according to claim 1, wherein the at least one optic guide comprises at least one optical medium through which the anti-fouling light generated by the at least one light source travels.

4. The cooling apparatus according to claim 3, wherein the at least one optical medium comprises spaces filled with at least one of a gas and clear water for guiding at least part of the anti-fouling light through the spaces.

5. The cooling apparatus according to claim 3, wherein the at least one optical medium is a light spreader arranged in front of the at least one light source for spreading at least part of the anti-fouling light emitted by the at least one light source in one or more directions having a component substantially perpendicular to the exterior portion of the at least one tube.

6. The cooling apparatus according to claim 3, wherein the at least one optical medium includes a light guide.

7. The cooling apparatus according to claim 6, wherein the at least one optical medium has a light coupling-in surface for coupling in the anti-fouling light from the at least one light source and a light coupling-out surface for coupling-out the anti-fouling light in a direction towards the exterior portion of the at least one tube.

8. A cooling apparatus for cooling a fluid by surface water, the cooling apparatus comprising:

tubes configured to contain and transport the fluid in the tubes, an exterior of at least one tube of the tubes being in operation at least partially submerged in the surface water so as to cool the tubes to thereby also cool the fluid;

at least one light source configured to generate anti-fouling light that hinders fouling on at least part of the exterior submerged in the surface water; and at least one optic guide configured to guide the anti-fouling light towards the at least part of the exterior submerged in the surface water, wherein the at least one optic guide comprises at least one optical medium through which the anti-fouling light generated by the at least one light source travels, and wherein the at least one optical medium has at least one guiding material with a refractive index higher than the refractive index of the surface water such that at least part of the anti-fouling light is propagated through the at least one optic guide via total internal reflection in a direction substantially parallel to the exterior of the at least one tube before being out-coupled at a light out-coupling surface.

9. The cooling apparatus according to claim 2, wherein the optical medium is includes one of glass, glass fiber, silicones and transparent plastic.

10. The cooling apparatus according to claim 1, wherein the at least one light source includes an internal light source located between the tubes and an external light source located at the external portion of the at least one tube, and wherein the at least one optic guide further comprises a reflector located by the external light source and configured to restrict propagation of light waves away from the external light source and to reflect the anti-fouling light from the external light source towards the exterior portion of the at least one tube.

11. The cooling apparatus according to claim 1, wherein the tubes includes a tube bundle having a width and comprising tube layers arranged in parallel along the width such that each tube layer of the tube layers comprises a plurality of hairpin type tubes having two straight tube portions and one semicircular portion so as to form a U-shaped tube portion, and wherein the tubes are disposed with the U-shaped tube portions concentrically arranged and the straight tube portions arranged in parallel, so that innermost U-shaped tube portions are of small radius and outermost U-shaped tube portions are of large radius larger than the small radius, with remaining intermediate U-shaped tube portions having progressively graduated radius of curvature between the small radius and the large radius.

12. The cooling apparatus according to claim 1, wherein the tubes are at least partially coated with a light reflective coating.

13. A ship according comprising:

an engine;

a hull for housing the engine;

partition plates, the hull and the partition plates defining a closed box with entry and exit openings;

a cooling apparatus for cooling a fluid by surface water to cool the engine, the cooling apparatus being placed in the closed box so that sea water can freely enter the closed box, flow over the cooling apparatus and exit via natural flow through the entry and exit openings, wherein inner surfaces of the closed box in which the cooling unit is placed are at least partially coated with a light reflective coating, and wherein the cooling apparatus comprises:

tubes configured to contain and transport the fluid in the tubes, an exterior of at least one tube of the tubes being in operation at least partially submerged in the surface water so as to cool the tubes to thereby also cool the fluid;

at least one light source configured to generate anti-fouling that hinders fouling on at least part of the exterior submerged in the surface water; and at least one optic guide configured to guide the anti-fouling light towards the at least part of the exterior submerged in the surface water, wherein the at least one optic guide comprises at least one optical medium through which the anti-fouling light generated by the at least one light source travels, and wherein the at least one optical medium has at least one guiding material with a refractive index higher than the refractive index of the surface water such that at least part of the anti-fouling light is propagated through the at least one optic guide via total internal reflection in a direction substantially parallel to the exterior of the at least one tube before being out-coupled at an out-coupling surface.

14. The cooling apparatus of claim 8, wherein the at least one optical medium has a light coupling-in surface for coupling in the anti-fouling light from the at least one light source, the light coupling-out surface coupling-out the anti-fouling light in a direction towards the exterior of the at least one tube.

15. The cooling apparatus of claim 8, wherein the at least one optic guide at least partially lies in between two adjacent tubes of the tubes.

16. The cooling apparatus of claim 8, wherein the at least one optical medium comprises spaces filled with at least one of a gas and clear liquid for guiding at least part of the anti-fouling light through the spaces.

17. The cooling apparatus of claim 8, further comprising a light spreader arranged in front of the at least one light source for spreading at least part of the anti-fouling light emitted by the at least one light source in one or more directions having a component substantially perpendicular to the exterior of the at least one tube.

18. The cooling apparatus of claim 8, wherein the optical medium includes one of glass, glass fiber, silicones and transparent plastic.

19. The cooling apparatus of claim 8, wherein the optical medium includes a rod extending from the at least one light source towards the tubes.

20. The cooling apparatus of claim 8, wherein the at least one optic guide further comprises a reflector configured to restrict propagation of light waves away from and to reflect the anti-fouling light towards the exterior of the at least one tube.

* * * * *